US008627715B2

(12) United States Patent
Pace et al.

(10) Patent No.: US 8,627,715 B2
(45) Date of Patent: Jan. 14, 2014

(54) IMAGING SUBSURFACE FORMATIONS WHILE WELLBORE DRILLING USING BEAM STEERING FOR IMPROVED IMAGE RESOLUTION

(75) Inventors: Nicholas G. Pace, Bath (GB); Jacques Y. Guigné, Paradise (CA)

(73) Assignee: Intelligent Sciences, Ltd., Paradise, NL (CA)

( * ) Notice: Subject to any disclaimer, the term of this patent is extended or adjusted under 35 U.S.C. 154(b) by 395 days.

(21) Appl. No.: 13/011,965

(22) Filed: Jan. 24, 2011

(65) Prior Publication Data

US 2012/0186335 A1 Jul. 26, 2012

(51) Int. Cl.
*E21B 47/14* (2006.01)

(52) U.S. Cl.
USPC ..... 73/152.47

(58) Field of Classification Search
USPC ..... 73/152.47
See application file for complete search history.

(56) References Cited

U.S. PATENT DOCUMENTS 4,601,024 A * 7/1986 Broding ..... 367/86
5,001,676 A * 3/1991 Broding ..... 367/31
5,639,997 A * 6/1997 Mallett ..... 181/102
5,640,371 A * 6/1997 Schmidt et al. ..... 367/153
5,671,136 A * 9/1997 Willhoit, Jr. ..... 702/18
6,002,639 A * 12/1999 Birchak et al. ..... 367/35
6,125,079 A * 9/2000 Birchak et al. ..... 367/35
7,120,565 B1 * 10/2006 Shibazaki ..... 703/2
7,357,030 B2 * 4/2008 Novascone et al. ..... 73/649
2004/0206170 A1 * 10/2004 Chen et al. ..... 73/152.49
2007/0234787 A1 * 10/2007 Rabinovich et al. ..... 73/152.02
2008/0307875 A1 * 12/2008 Hassan et al. ..... 73/152.16

* cited by examiner

*Primary Examiner* — Hezron E Williams
*Assistant Examiner* — Mark A Shabman
(74) *Attorney, Agent, or Firm* — Richard A. Fagin

(57) ABSTRACT

A system for imaging rock formations while drilling a wellbore includes a drill collar and a plurality of acoustic emitting transducers mounted in the drill collar at angularly spaced apart locations and oriented to emit acoustic energy at least one of laterally away from the drill collar and longitudinally away from the drill collar. A plurality of arrays of acoustic transducers arranged is longitudinally along the drill collar and angularly spaced apart from each other. Each transducer in the plurality of arrays is oriented normal to a longitudinal axis of the collar. Angular spacing between adjacent arrays is selected to provide lateral beam steered receiving response having a selected main lobe width and side lobe response for a plurality of rock formation acoustic velocities. A controller selectively actuates the emitting acoustic transducers at selected times. The controller beam steers response of the plurality of arrays of transducers to detect reflected acoustic energy from the emitting acoustic transducers.

8 Claims, 8 Drawing Sheets

IMAGING SUBSURFACE FORMATIONS WHILE WELLBORE DRILLING USING BEAM STEERING FOR IMPROVED IMAGE RESOLUTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of imaging subsurface formations while drilling wellbores therethrough. More specifically, the invention relates to instrument structures and signal processing techniques for such imaging that can provide enhanced resolution and formation identification.

2. Background Art

Instruments are known in the art for creating a representation of a visual image of subsurface formations while a wellbore is being drilled through such formations. Such instruments include devices that measure formation resistivity, acoustic wave properties, formation density, neutron porosity, neutron capture cross section and nuclear magnetic resonance properties, among others. Typically one or more of such sensors is mounted in one or more "drill collars" (a drill collar being a thick-walled segment of drill pipe) coupled within a drill string. The drill string is a long pipe extending from the surface to the bottom of the well and is used to suspend and rotate a drill bit to lengthen the wellbore by drilling the subsurface formations. As the drill string moves along the wellbore, whether during drilling or during pipe movements subsequent to drilling (e.g., reaming, washing, tripping) measurements such as the foregoing may be made at various rotary orientations of the drill string. The measurement value and the rotary orientation may be recorded in suitable storage devices in the instrument and/or may be transmitted to the surface using various forms of drill string telemetry.

A limitation to the imaging techniques known in the art is that they generally are limited as to the distance in the formation that can be examined or imaged. There exists a need for formation imaging devices that can determine the equivalent of visual properties of formations at substantially greater distances from the wellbore than the capabilities of instruments known in the art.

SUMMARY OF THE INVENTION

A system for imaging rock formations while drilling a wellbore according to one aspect of the invention includes a drill collar and a plurality of acoustic emitting transducers mounted in the drill collar at angularly spaced apart locations and oriented to emit acoustic energy at least one of laterally away from the drill collar and longitudinally away from the drill collar. A plurality of arrays of acoustic transducers arranged is longitudinally along the drill collar and angularly spaced apart from each other. Each transducer in the plurality of arrays is oriented normal to a longitudinal axis of the collar. Angular spacing between adjacent arrays is selected to provide lateral beam steered receiving response having a selected main lobe width and side lobe response for a plurality of rock formation acoustic velocities. A controller selectively actuates the emitting acoustic transducers at selected times. The controller beam steers response of the plurality of arrays of transducers to detect reflected acoustic energy from the emitting acoustic transducers.

A method for imaging formations surrounding a wellbore according to another aspect of the invention includes emitting acoustic energy around the circumference of the wellbore at least one of longitudinally and laterally away from the drill collar into the wellbore. Reflected acoustic energy is detected along selected longitudinal lengths with respect to the wellbore at angularly spaced apart locations. An angular spacing between adjacent longitudinal lengths is selected to enable detecting the reflected acoustic energy related to a plurality of acoustic velocities of the formations. The detecting is performed by beam steering the detected acoustic energy to have highest sensitivity within a selected angle and side lobe response from the selected angle being reduced by at least a predetermined amount.

Other aspects and advantages of the invention will be apparent from the following description and the appended claims.

DETAILED DESCRIPTION

Figure 1:
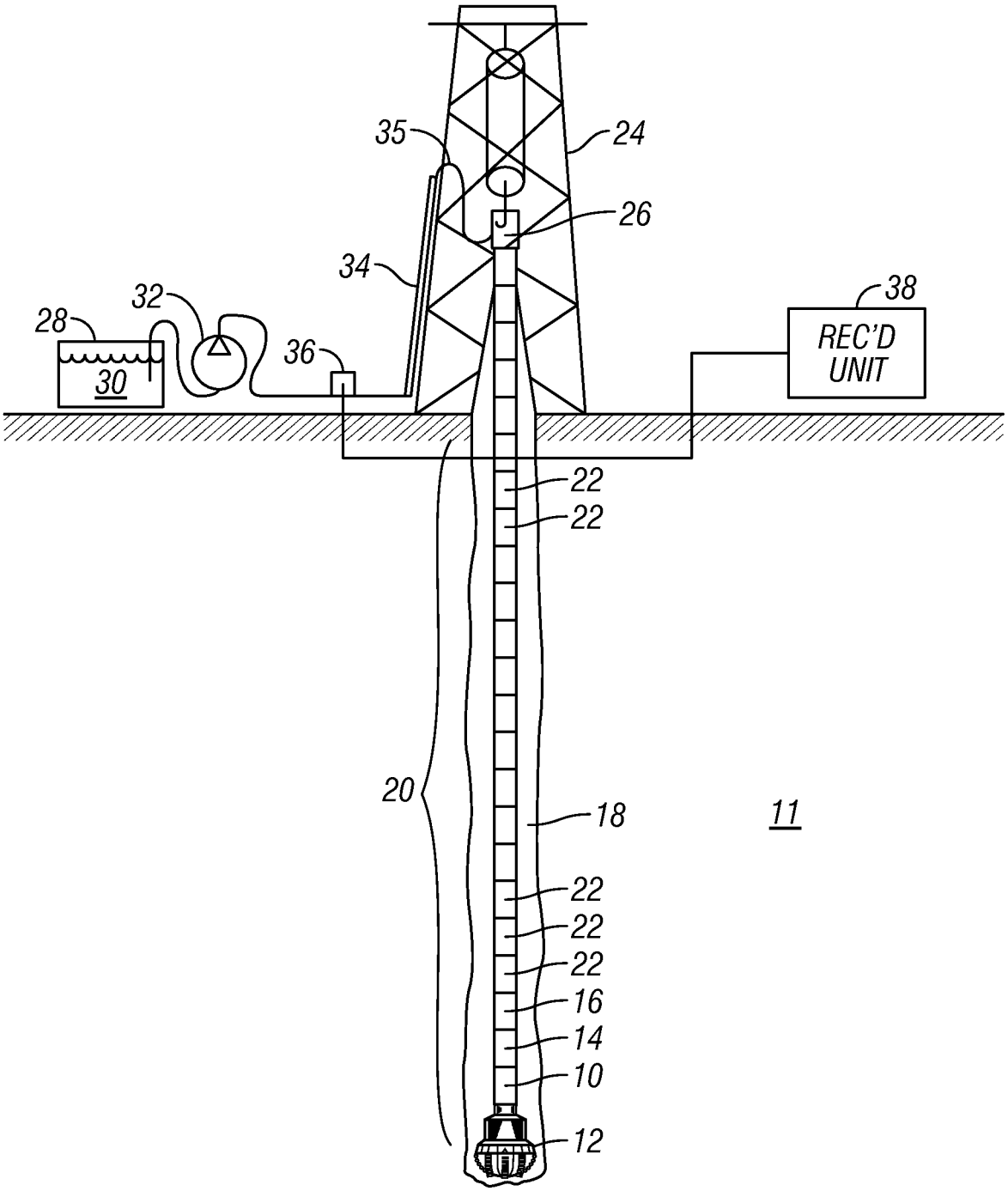
FIG. 1 shows an example drilling system with which the invention may be used.

An example wellbore instrumentation system with which various implementations of the invention may be used is shown schematically in FIG. 1. The present example is described in terms of drilling instrumentation, however it should be understood that certain aspects of the invention have application in any wellbore measurement system. Therefore, the invention is not limited in scope to drilling instrumentation.

In FIG. 1, a drilling rig 24 or similar lifting device suspends a conduit called a "drill string 20" within a wellbore 18 being drilled through subsurface Earth formations 11. The drill string 20 may be assembled by threadedly coupling together end to end a number of segments ("joints") 22 of drill pipe. The drill string 20 may include a drill bit 12 at its lower end. When the drill bit 12 is axially urged into the formations 11 at the bottom of the wellbore 18 and when it is rotated by equipment (e.g., top drive 26) on the drilling rig 24, such urging and rotation causes the bit 12 to axially extend ("deepen") the wellbore 18. The lower end of the drill string 20 may include, at a selected position above and proximate to the drill bit 12, a formation imaging instrument 10 according to various aspects of the invention and which will be further explained below. Proximate its lower end of the drill string 20 may also include an MWD instrument 14 and an LWD instrument 16 of types well known in the art. Power to operate the various instruments may be provided by a turbine/generator combination (not shown) in the MWD instrument 14, or by local storage such as batteries (not shown).

During drilling of the wellbore 18 or during "circulating" activities, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the drill string 20. The mud 30 exits the drill string 20 through courses or nozzles (not shown separately) in the drill bit 12, where it then cools and lubricates the drill bit 12 and lifts drill cuttings generated by the drill bit 12 to the Earth's surface. Some examples of MWD instrument 14 or LWD instrument 16 may include a telemetry transmitter (not shown separately) that modulates the flow of the mud 30 through the drill string 20. Such modulation may cause pressure variations in the mud 30 that may be detected at the Earth's surface by a pressure transducer 36 coupled at a selected position between the outlet of the pump 32 and the top drive 26. Signals from the transducer 36, which may be electrical and/or optical signals, for example, may be conducted to a recording unit 38 for decoding and interpretation using techniques well known in the art. The decoded signals typically correspond to measurements made by one or more of the sensors (not shown) in the MWD instrument 14 and/or the LWD 16 instrument as well as the formation imaging instrument 10.

It will be appreciated by those skilled in the art that the mud flow modulation telemetry described above has relatively limited bandwidth, limited to approximately 10 bits per second. As will be explained below with reference to FIG. 7, signals detected by the formation imaging instrument 10 may be stored in an internal data storage device, and selected portions of such stored signals may be transmitted using the mud flow modulation telemetry. Suitable data compression techniques known in the art may increase the amount of imaging data that may be transmitted to the surface during drilling operations. Alternatively, the drill string 20 may include an electromagnetic signal channel therein, such drill string known in the art as "wired drill pipe." Such electromagnetic signal channels may have data transmission rates as high as $10^6$ bits per second. One such wired drill pipe system is described in U.S. Pat. No. 7,535,377 issued to Hall et al. and incorporated herein by reference.

It will also be appreciated by those skilled in the art that the top drive 26 may be substituted in other examples by a swivel, kelly, kelly bushing and rotary table (none shown in FIG. 1) for rotating the drill string 20 while providing a pressure sealed passage through the drill string 20 for the mud 30. Accordingly, the invention is not limited in scope to use with top drive drilling systems.

Figure 2:
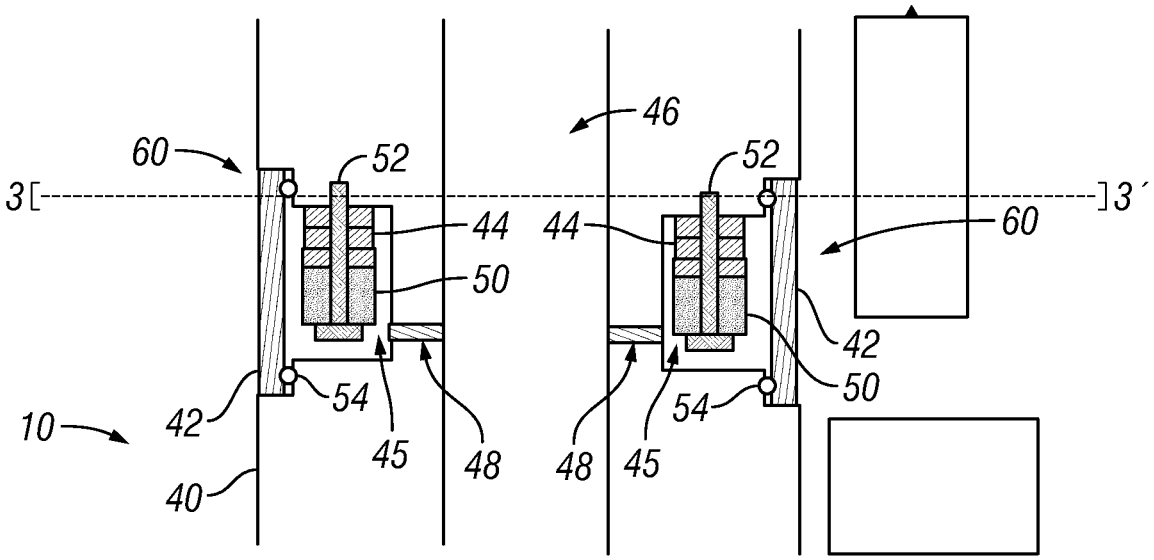
FIG. 2 shows a cross section of a drill collar including "longitudinal emitting" transducers.

An example imaging while drilling instrument (such as at 10 in FIG. 1) will be explained with reference to desirable components for look ahead (longitudinal) and side looking (lateral) wellbore acoustic imaging. FIG. 2 shows a cross section of the instrument 10 proximate the bottom of the drill string (20 in FIG. 1) and preferably near the drill bit (12 in FIG. 1). A plurality (in the present example case four) acoustic energy emitting transducers 60 ("longitudinal emitting transducers") may be positioned in oil-filled recesses 45 formed into the exterior of the drill collar 40 to house the longitudinal emitting transducers 60. The longitudinal emitting transducers 60 are configured to emit acoustic energy when actuated longitudinally from the drill collar 40.

Each recess 45 may include a pressure equalization tube 48 to ensure that differential pressure between the internal passage 46 in the drill string and in the wellbore (18 in FIG. 1) does not become excessive, or dampen the acoustic energy emitted by the longitudinal emitting transducers 60. Each longitudinal emitting transducer 60 may include a piezoelectric actuator 44, such as may be made from ceramic, PZT or similar material. The actuator 44 and a mass 50 may be mounted on a stress bolt 52 that couples motion of the actuator 44 and mass 50 into the body of the collar 40. The recess 45 may be sealed on the exterior with a steel or similar cover, using o-rings 54 or the like to exclude wellbore fluid from entering the recess 45.

Figure 3:
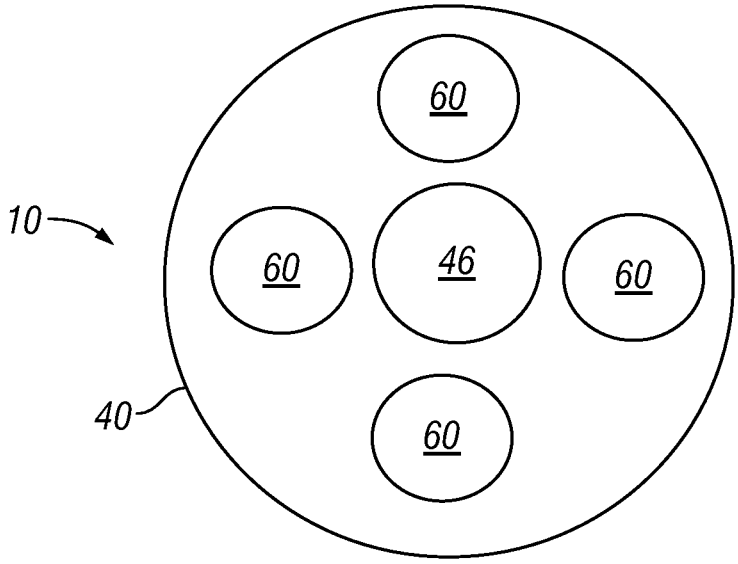
FIG. 3 shows an end view of the drill collar section shown in FIG. 2.

As can be seen in end view in FIG. 3, four of the longitudinal emitting transducers 60 explained with reference to FIG. 2 may be equally circumferentially spaced about the drill collar 40. When actuated, the longitudinal emitting transducers' 60 energy output is directed toward the drill bit.

Figure 4:
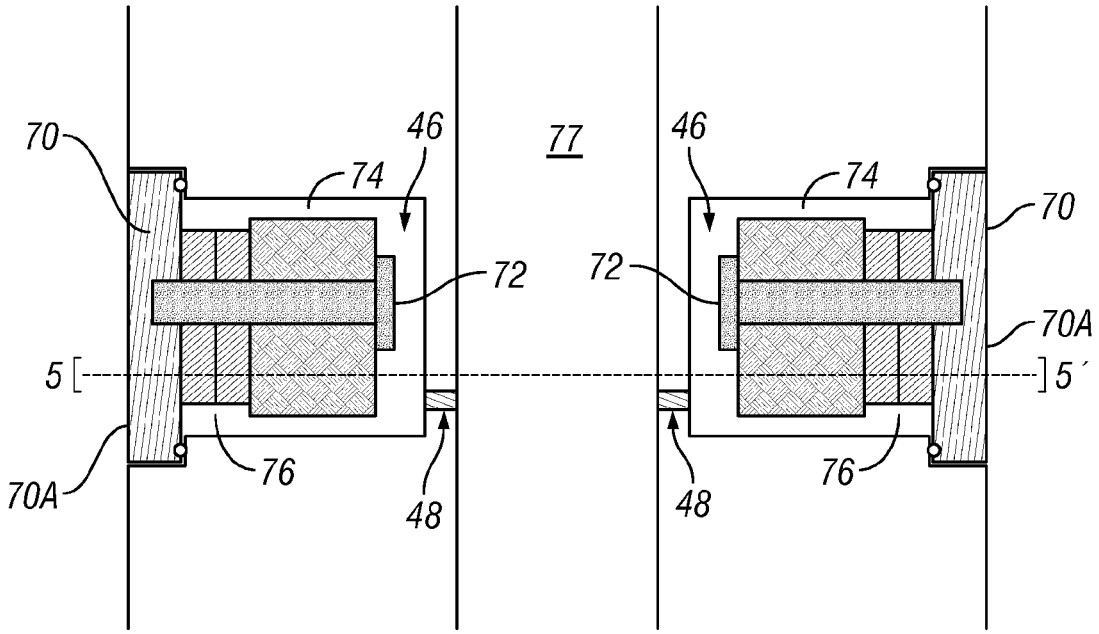
FIG. 4 shows an example of "side-looking" transducers in the collar wall.
Figure 5:
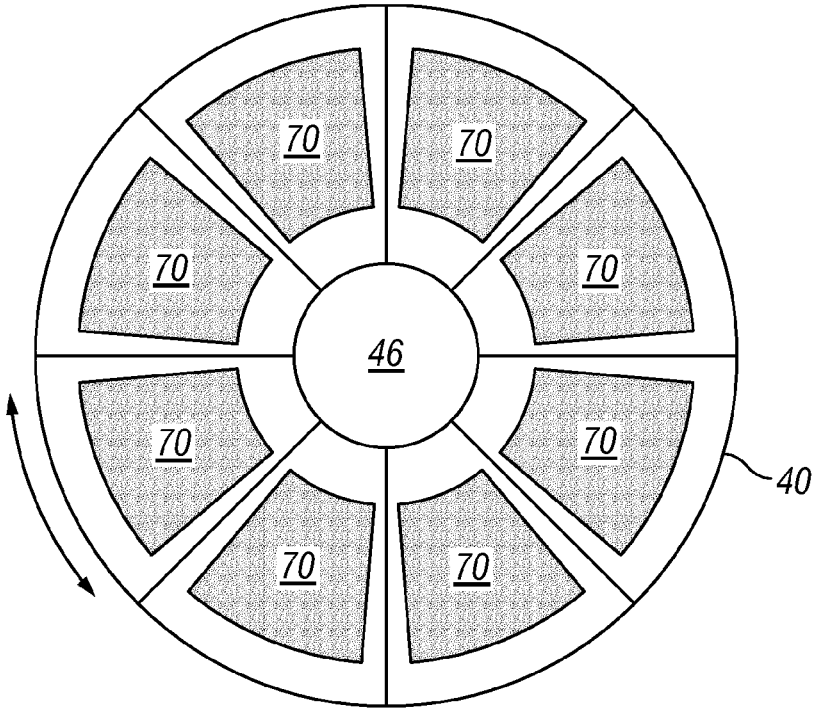
FIG. 5 shows a cut away view of the collar including the side-looking transducers.

A different type of transducer 70, although similar in structure to the longitudinal emitting transducers (60 in FIG. 2) may be mounted in the wall of the drill collar 40. FIG. 4 shows a cross section of part of the collar 40 generally above the position of the longitudinal emitting transducers (60 in FIG. 2). A selected number of such "lateral emitting" transducers 70 may be mounted about the circumference of the collar 40. Each lateral emitting transducer 70 may be mounted in an oil filled recess 77, and may include a coupling 72, sealed cover 70A, piezoelectric element 76 and a mass 74. In the present example, the coupling is oriented so that energy from the transducer 70 is directed laterally outwardly from the collar 40. FIG. 5 shows a stylized cross section of part of the collar including eight, equally circumferentially spaced lateral emitting transducers 70, although other examples may include more or fewer thereof.

It should also be noted that while the transducers have all been described as using piezoelectric active elements, other types of transducer active elements may also be used, such as magnetostrictive elements.

Figure 6:
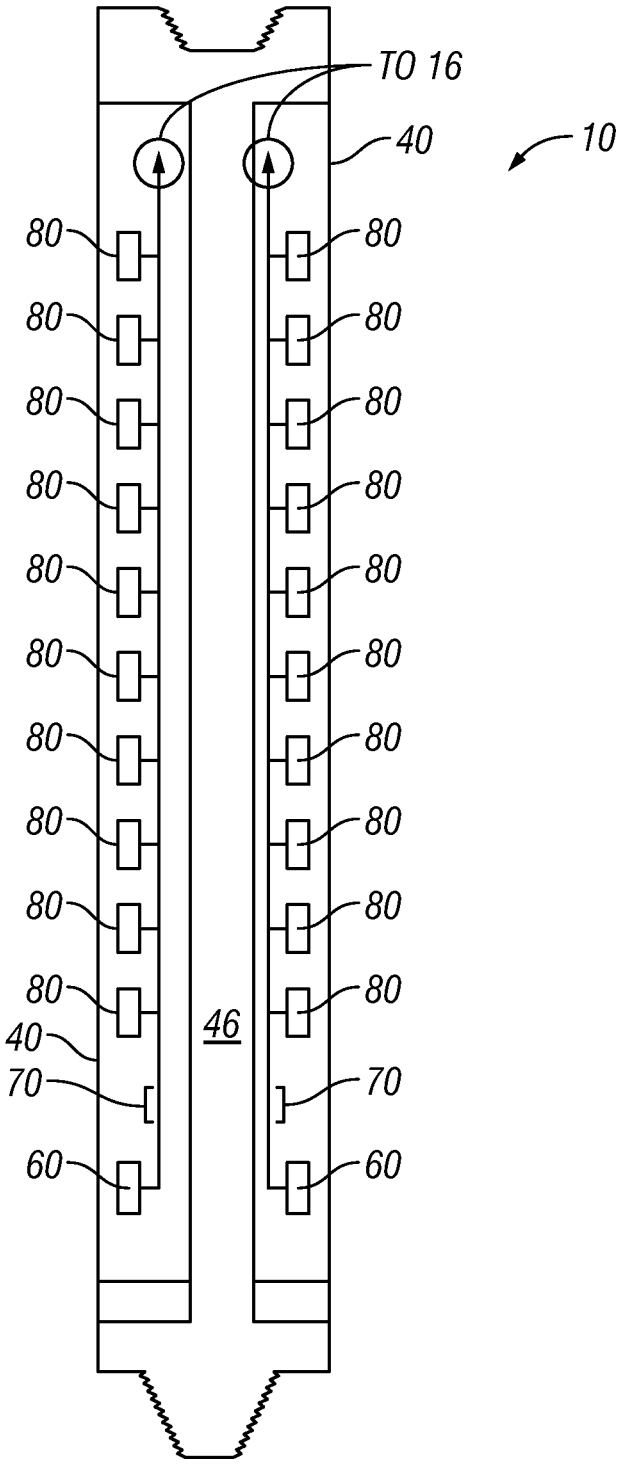
FIG. 6 shows a side, cut away view of an example imaging device.

FIG. 6 shows one example in cut away view of the imaging device 10. The longitudinal emitting transducers 60 are located near the bottom of the collar, and may be made and mounted thereto as explained with reference to FIG. 2. The lateral emitting transducers 70 may be mounted and made as explained with reference to FIG. 5. In the present example, a plurality of lateral emitting transducers 70 are mounted in each circumferential position about the collar 40.

Figure 6A:
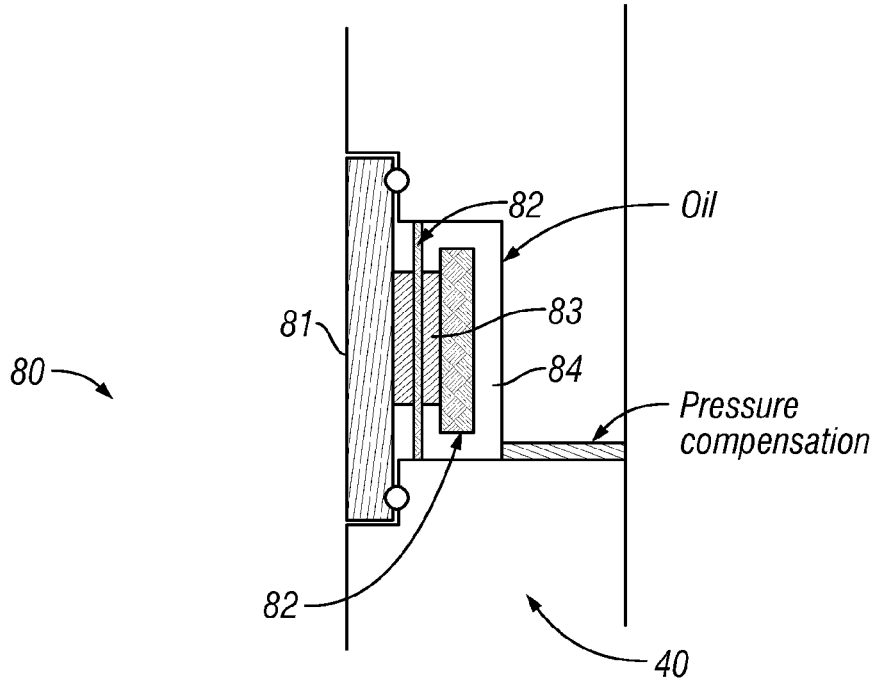
FIG. 6A shows an example receiving transducer mounted in a drill collar wall.

Receiving transducers 80, which may be piezoelectric transducers, may be arranged in "lines" in suitable recesses in the wall of the collar 40. The receiving transducers 80 may be specifically designed to receive acoustic energy both the lateral emitting transducer (e.g., 25 kHz) and the longitudinal emitting transducer (e.g., 15 kHz) frequencies. An example receiving transducer 80 is shown in FIG. 6A and includes a transducer element 83, such as a piezoelectric element, disposed in an oil filled, pressure compensated chamber 84 in the wall of the drill collar 40. The chamber 84 may be sealed by a cover 81 as is the case for the other transducers. In the present example, the problem of coupling of the accelerations in the drill collar into the transducer element 83 may be reduced by using a balanced design, nodal mount 82. In the present example, there may be ten, unequally angularly spaced apart lines of such transducers 80, each line including sixty receiving transducers 80. The receiving transducers 80 may be longitudinally spaced so that each line is about 5 meters overall length. The number of receiving transducers 80, the longitudinal spacing, the number of lines and the angular separation between adjacent lines may be selected to optimize beamforming during signal reception, however the number of lines, length of each line, angular spacing between adjacent lines and the number of receiving transducers in each such line explained herein are only examples. Other implementations may use different numbers of lines and different numbers of receiving transducers in each line.

Figure 6B:
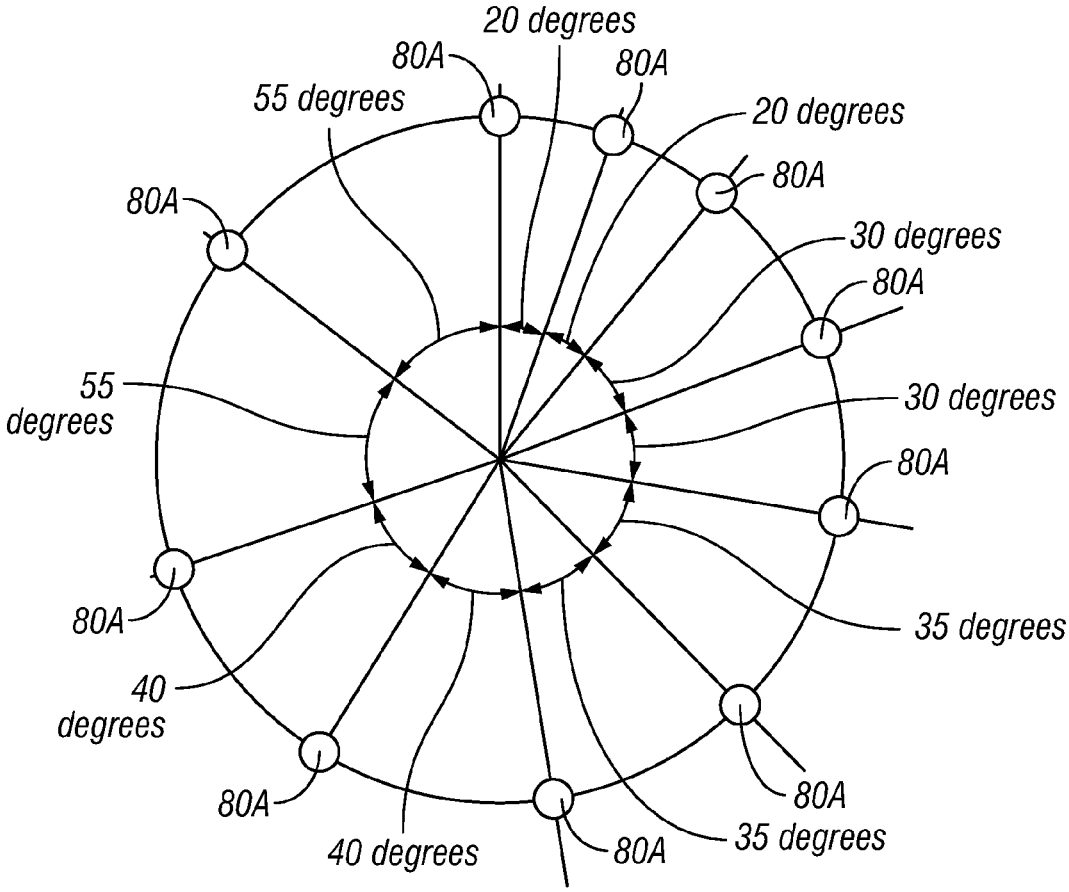
FIG. 6B shows example angular spacing between phase centers of sets of receiving transducer lines.

An example angular separation of the lines of receiving transducers is shown in FIG. 6B. The direction of the phase center axis of each of a plurality of sets of three adjacent lines of receiving transducers is indicated at 80A, and the angular spacing between the phase center axes of adjacent sets of lines is indicated in each of the circumferential segments by a specific number of degrees.

Figure 7:
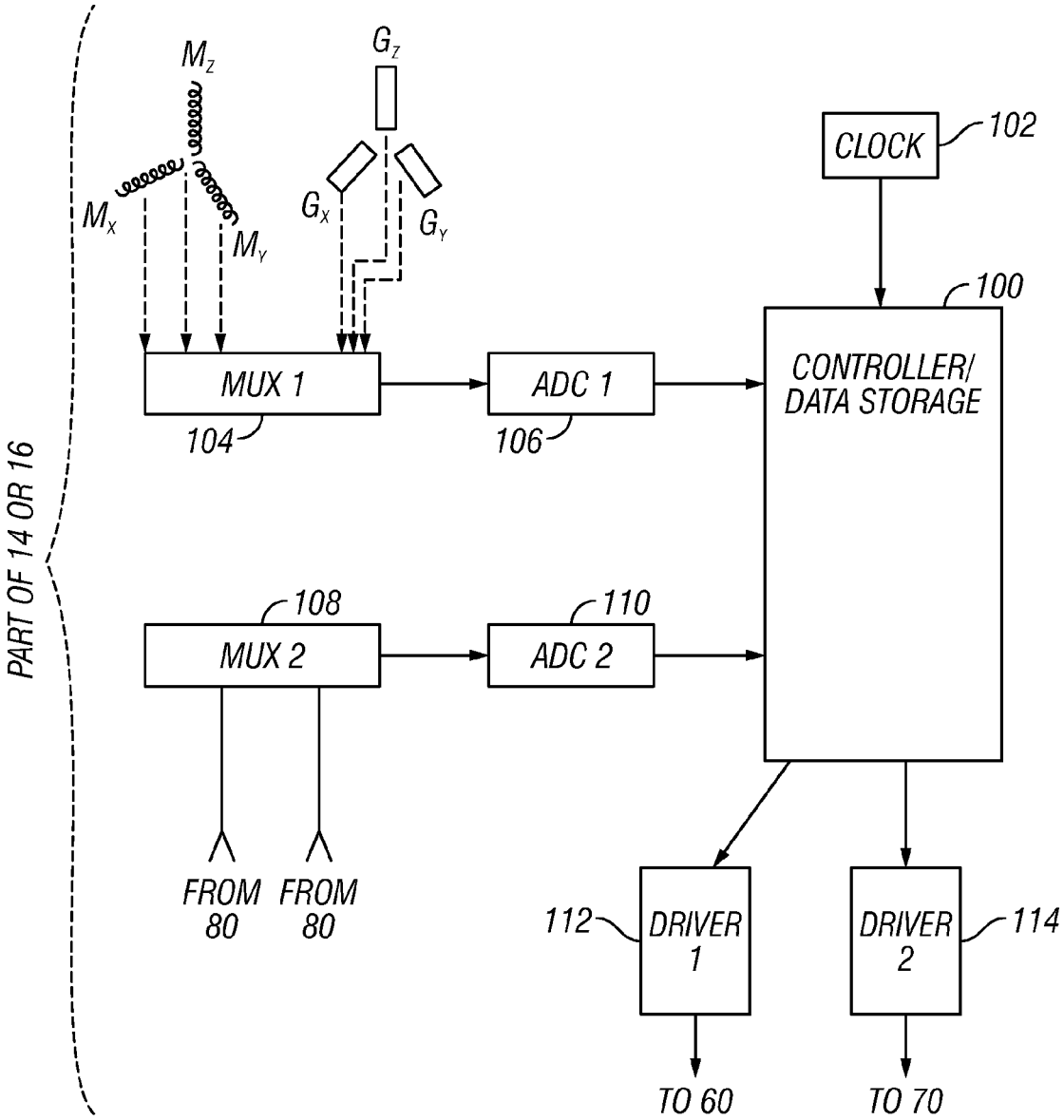
FIG. 7 shows an example of signal processing circuitry that may be used with an imaging instrument.

An example of signal acquisition and processing circuitry that may be used in some implementations of an imaging instrument is shown in a functional block diagram in FIG. 7. Typically, although not necessarily, such circuitry may be located in the LWD instrument (16 in FIG. 1) or the MWD instrument (14 in FIG. 1). In particular, the MWD instrument 14 typically includes devices to determine the geodetic orientation of the instrument, both longitudinally and rotationally, at any moment in time. Such instrumentation may include triaxial flux gate magnetometers Mx, My, Mz to determine the geomagnetic orientation of the instrument, and triaxial accelerometers Gx, Gy, Gz to determine the gravitational orientation of the instrument. In combination, the six component measurements above may be used to determine the geodetic orientation of the instrument. As a general convention, Z is along the longitudinal axis of the instrument, and the X and Y axes are in a plane orthogonal to the axis and are mutually orthogonal with respect to each other. Such measurements when made may be time stamped and stored as explained below.

During times that the collar (40 in FIG. 6) is rotating, the rotary orientation of the collar may be determined at relatively high rates (in excess of 3 KHz) by interrogating the magnetometers Mx, My, Mz. Measurements made from each of these may be multiplexed in a first multiplexer 104 (as well as the accelerometer measurements during non-rotating measurement), digitized in a first analog to digital converter (ADC) 106 and stored in a mass storage unit associated with a system controller 100. Time stamps for the measurements may be provided by a system clock 102. The controller 100 may be programmed to operate the longitudinal emitting transducers (60 in FIG. 2) by sending an appropriate control signal to a first driver/power amplifier 112. The lateral emitting transducers (70 in FIG. 5) may be similarly operated using a second driver/power amplifier 114.

Detected signals from the receiving transducers 80 may be multiplexed in a second multiplexer 108, digitized in a second ADC 110 and stored with a time stamp thereon from the system clock 102 in the storage part of the controller 100. The controller 100 may be configured to perform certain signal processing of the detected signals as will be explained further below. Because both the detected signals from the receiving transducers 80 and the signals related to rotary orientation obtained as explained above are time stamped, it is possible to associate the rotary orientation of the collar 40 with the detected acoustic signals. The rotational orientation associated signals may be used to generate an image around the entire circumference of the wellbore (18 in FIG. 1).

Referring once again to FIG. 6, the lateral emitting transducers 70 produce eight acoustic beams propagating radially from the drill collar 40, each of which independently has a broad beam in both the vertical and horizontal (with reference to the drill collar) planes. The center axes of the respective lateral emitting transducers 70, if configured as explained with reference to FIG. 5, may be too far apart for their acoustic output to be combined in a useful manner, but a larger number of lateral emitting transducers, more closely spaced in angular separation is within the scope of the present invention. Thus, when the lateral emitting transducers 70 are all actuated at any given time there are eight acoustic beams projecting substantially horizontally from the drill collar 40.

As explained above, there may be ten lines of sixty receiving transducers 80 along the drill collar. The lines may be spaced non-uniformly with respect to angle around the drill collar as shown in FIG. 6B. Certain arrangements of unequal angular spacing may be selected so that it is possible to form five combinations of the signals detected by the receiving transducers 80 in sets of three lines of receiving transducers 80. The output of a set of three lines may be processed together, by using suitable beam steering (e.g., as may be performed by the processor 100 in FIG. 7) to provide a selected horizontal beam width. The angular separation between the center line and the outer two lines of any set of three lines of receiving transducers 60 may be chosen with regard to the expected acoustic velocity (wavelength) in the formations surrounding the instrument while a wellbore is drilled. If a requirement is set such that the major beam lobe is less that 60 degrees full width and sidelobes are at least 5 dB down then the following results shown in Table 1 were obtained by simulation of the receiving transducer response.

TABLE 1

BEAM WIDTH AND SIDELOBE AMPLITUDE FOR SELECTED ACOUSTIC VELOCITIES

| Acoustic Velocity (meters/sec.) | Receiving Transducer Angular Separation (degrees) | Main Lobe Full Width (Degrees) | Sidelobe Level (dB) |
|---|---|---|---|
| 1500 | 20 | 40 | −8 |
| 2000 | 30 | 38 | −6 |
| 3000 | 30-40 | 40 | −6 |
| 4000 | 40-50 | 49 | −6 |
| 5000 | 50-60 | 54 | −7 |

Thus having selected an appropriate set of three lines of receiver transducers, and with suitable beam steering (which may be performed by suitable time delay to the signals detected by the receiving transducers in each line thereof) the receiving transducers will detect acoustic energy in an overall beam pattern of width in the horizontal plane of about 40 degrees, and in the vertical plane about 2 degrees (dependent on the acoustic velocity for a fixed length of the receiving transducer lines of about 5 meters). The range resolution is effectively controlled by the pulse length of the energy emitted by the lateral emitting and longitudinal emitting transducers, but the range resolution is also influenced by the focusing, as the detected signals will generally be in the near field of each line of receivers. As the drill string rotates and advances, images will be produced out to about 15 meters laterally into the rock formations. Alternatively, each line of receiving transducers could be used all the time to receive reflected signals from the eight lateral emitting transducers. In such case, the receiving transducers may be beam steered to have a broad horizontal beam and a narrow vertical beam and range resolution determined by a combination of transmitted pulse length and the depth of focus of the beam steering. Thus, it is possible to acquire acoustic signals from the lateral emitting transducers (70 in FIG. 4) around the entire circumference of the wellbore (18 in FIG. 1) at selected lateral distances into the formations around the wellbore over a range of acoustic formation velocities.

Producing an image from the detected, beamformed signals may be performed using any suitable technique known in the art. Such techniques include, as non-limiting examples, presenting a signal amplitude represented by a color or gray scale intensity in a two dimensional plot, wherein the two dimensions are depth in the wellbore and rotational orientation of the detected signals. Such a two dimensional plot may be made for each of a plurality of lateral distances into the formations depending on the lateral position of the beam steered response. Alternatively, plots in two dimensions may be made with respect to depth and lateral distance, with each of a plurality of such plots representing a rotational orientation and/or circumferential sectors of rotation.

Figure 8A:
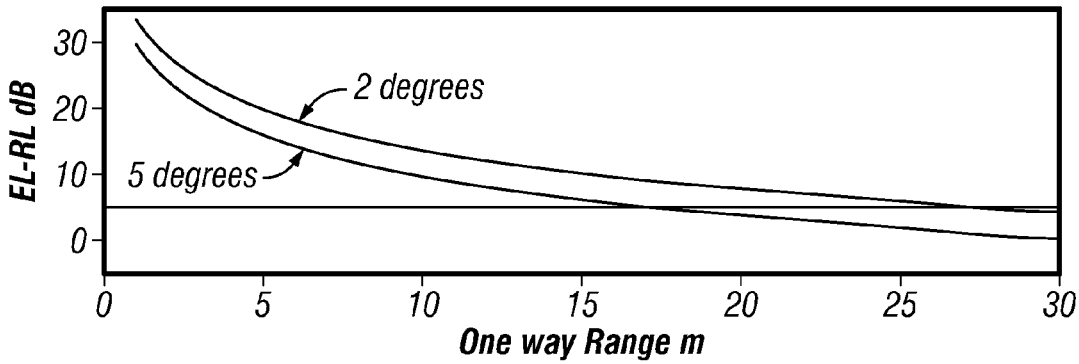
FIGS. 8A and 8B show simulated response of the instrument to objects located laterally outward from the drill collar.
Figure 8B:
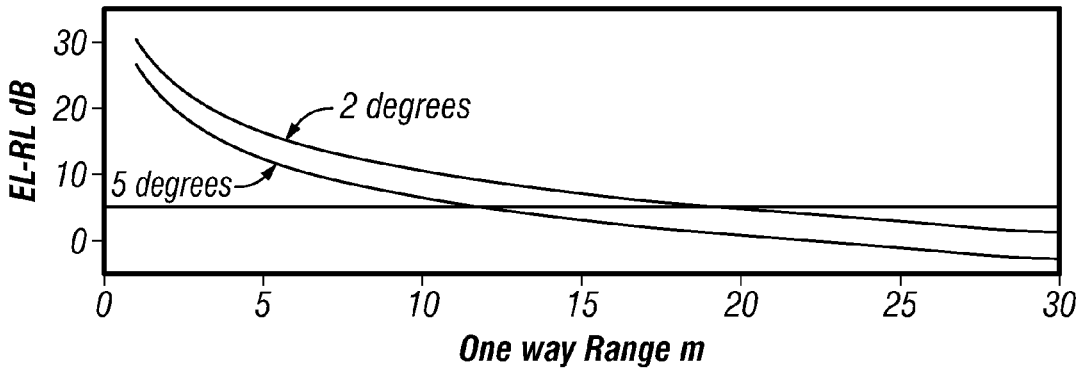

FIG. 8A and FIG. 8B show graphs of simulated reflection (echo) amplitude with respect to reverberation amplitude for range (lateral distance into the formation), receiving beam width (curves indicated as two and five degrees, respectively) and transmitted pulse length in number of cycles, five and ten cycles, respectively. For purposes of the simulation, a formation having porosity of 50%, an acoustic energy frequency of 25 KHz, a formation velocity of 4500 meters/sec. and a 1 meter target object in the formation were used. Pore size for the simulated formation was 1 millimeter. The simulated response of the receiving transducers suggests that it is possible to produce a volume image of the rock formations around the drill collar of radial extent about 20 to 30 meters and of vertical extent about the same. The resolution in a vertical plane of the image is expected to be on the order of a meter at full range, while in the horizontal plane it will be of the order of 15 to 20 meters at full range depending on the formation acoustic velocity and the particular receiving transducer arrangement.

Figure 9:
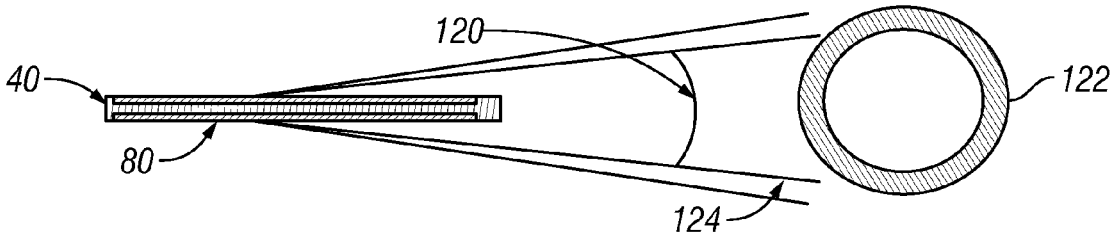
FIG. 9 shows simulated response of the instrument to objects located ahead of the drill bit.

The energy reflected from the longitudinal emitting transducers (60 in FIG. 2) may use the same receiving transducers (80 in FIG. 6), but the receiving transducer arrangement in longitudinal lines results in an endfire beam on reception. Referring to FIG. 9, the output of all lines of receiving transducers 80 may be combined using longitudinally configured beam steering, such as may be performed in the processor (100 in FIG. 7), to result in a beam pattern that is a ring 122 having a diameter, defined by conical angle 120 dependent on the phasing at a known series of ranges as the transmitted energy from the longitudinal emitting transducers (60 in FIG. 2) propagates from the drill bit. So at a given range it is possible to run through the phasing (or conical angles) to obtain an integrated response from a plurality of circles of known diameter. Such information may be gathered along with the lateral emitting transducer signal data and can be used later for complementing it. The beamforming, focusing and steering of the look-ahead received energy beam will result in an image that has resolutions of the order of a meter both in range and lateral displacement from the center line of the drill bit. Because the receiving transducer array spacing in the longitudinal direction may be selected for the shorter wavelengths of the 25 kHz lateral emitting transducer output, the wavelengths at the longitudinal emitting transducer frequency of 15 kHz will be sufficiently long in comparison with the receiving transducer longitudinal spacing spacing to allow vector intensity processing This will enable the determination of directions of acoustic energy flow in the detected signals from the longitudinal emitting transducers.

Figure 10:
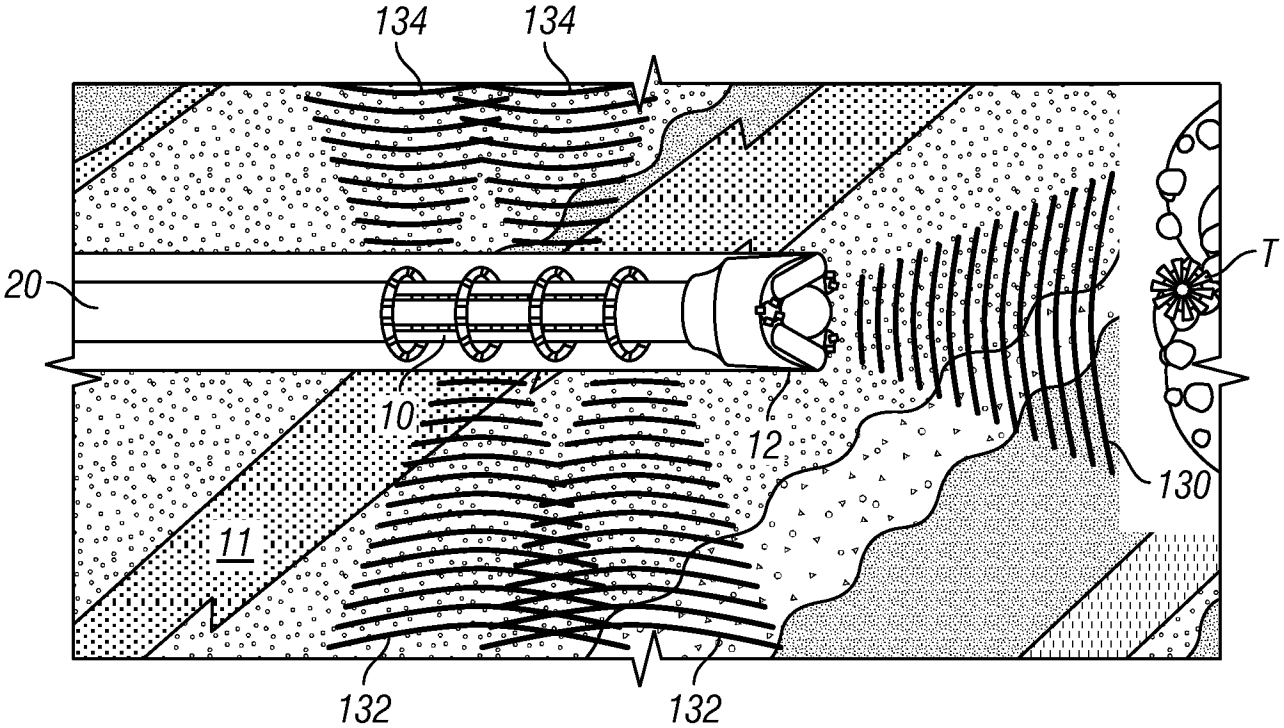
FIG. 10 shows a schematic representation of acoustic emission and detection both longitudinally and laterally from an instrument according to the invention.

A conceptual drawing of acoustic emission and detection of signals using an instrument and methods as described above is shown in FIG. 10. As the drill string 20 rotates, the longitudinal emitting transducers emit energy that may be transmitted through the drill bit 12 into the formations 11 disposed beyond the longitudinal extent of the wellbore. Such emission is shown generally at 130. A target T disposed longitudinally ahead of the drill bit 12 may be detected using the array of receiving transducers 80 as explained above with reference to FIG. 9. Lateral emission of acoustic energy is shown in different directions 132 and 134 from the lateral emitting transducers (70 in FIG. 4). It will be appreciated that simultaneous, or rapid sequential operation of the lateral emitting transducers (i.e., within several milliseconds to several tens of milliseconds of each other) will enable detection of reflected acoustic energy by the arrays of receiving transducers 80 at various angular spacings between line arrays to enable good response at various lateral depths into the formations 11 at a plurality of formation velocities as explained above with reference to TABLE 1.

While the foregoing example implementation includes both "longitudinal emitting" and "lateral emitting" emitting transducers, it is also within the scope of the present invention to include only the laterally oriented emitting transducers or the longitudinally emitting transducers in particular implementations. In such implementations, beam steering the response is performed as explained above with reference to the respective ones of the longitudinal emitting transducers and lateral emitting transducers.

The foregoing description of an imaging while drilling instrument and method for its use are described in terms of being used while a wellbore is being drilled. It should be clearly understood that the instrument can be used during other wellbore operations than actual drilling (lengthening) of the wellbore. Such operations include, without limitation, circulating, washing, reaming, and inserting into or removing some of all of the drill string (20 in FIG. 1) from the wellbore (18 in FIG. 1).

An imaging while drilling system according to the various aspects of the invention may enable identification of features in rock formations at significant and identifiable lateral distances from the wellbore, and may enable identification of features at smaller but still useful distances ahead of the drill bit. Such imaging may enhance understanding of the composition and structure of the rock formations and may assist in avoiding drilling hazards.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for imaging formations surrounding a wellbore, comprising:

emitting acoustic energy at least one of laterally around the circumference of the wellbore and longitudinally into the wellbore;

detecting reflected acoustic energy from the acoustic emitted energy along selected longitudinal lengths with respect to the wellbore at angularly spaced apart locations, an angular spacing between adjacent longitudinal lengths selected to enable detecting the reflected acoustic energy related to a plurality of acoustic velocities of the formations, the detecting performed by beam steering the detected acoustic energy to have highest sensitivity within a selected angle and side lobe response from the selected angle being reduced by at least a predetermined amount; and generating an image from the detected acoustic energy.

2. The method of claim 1 further comprising:

measuring a rotational orientation of the longitudinal lengths;

associating the detected acoustic energy with the measured rotational orientation; and generating an image from the detected acoustic energy associated with the measured rotational orientation.

3. The method of claim 1 further comprising rotating the longitudinal lengths around the interior of the wellbore, and generating an image corresponding to an entire circumference of the wellbore.

4. The method of claim 1 further comprising adjusting a focusing distance of the beam steering to detect reflected acoustic energy from a selected distances into the formations.

5. The method of claim 1 further comprising emitting acoustic energy into the wellbore longitudinally ahead of a drill bit;

detecting reflected acoustic energy along the longitudinal lengths; and beam steering a response of the detected reflected acoustic energy to generate an image of the formations at a selected distance longitudinally ahead of the drill bit.

6. The method of claim 5 further comprising changing an angular response of the beam steering to generate images at selected angular displacements from a longitudinal axis of the wellbore.

7. The method of claim 6 further comprising rotating the longitudinal lengths around the interior of the wellbore, and generating an image in circular patterns at the selected angular displacements, thereby generating an image in circular patterns having selected diameter.

8. The method of claim 1 wherein the emitting energy, detecting energy and generating an image is performed during drilling of the wellbore.

* * * * *